US006249419B1

(12) United States Patent
Casellato

(10) Patent No.: US 6,249,419 B1
(45) Date of Patent: Jun. 19, 2001

(54) CONTROL CIRCUIT FOR AN ELECTROMAGNET ASSOCIATED WITH AN ELECTRIC STARTER MOTOR FOR AN INTERNAL COMBUSTION ENGINE

(75) Inventor: Giancarlo Casellato, Turin (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 09/349,796

(22) Filed: Jul. 9, 1999

(30) Foreign Application Priority Data

Oct. 7, 1998 (IT) ..... TO98A0608

(51) Int. Cl.[7] ..... F02N 11/08
(52) U.S. Cl. ..... 361/160; 307/10.6
(58) Field of Search ..... 361/160, 152–156, 361/187; 307/10.6, 130, 131; 123/179.1, 179.3; 290/38 R

(56) References Cited

U.S. PATENT DOCUMENTS 4,032,792 * 6/1977 Parkyn et al. ..... 290/37 R
5,601,058 * 2/1997 Dyches et al. ..... 123/179.3
5,970,937 * 10/1999 Casellato et al. ..... 123/179.3

FOREIGN PATENT DOCUMENTS 0562457 9/1993 (EP) .
0727577 8/1996 (EP) .
0844388 5/1998 (EP) .

* cited by examiner

*Primary Examiner*—Fritz Fleming
(74) *Attorney, Agent, or Firm*—Sughrue, Mion, Zinn, Macpeak & Seas, PLLC

(57) ABSTRACT

A circuit device is described for controlling the piloting voltage applied to the solenoid of an electromagnet associated with an electric starter motor of an internal combustion engine of a motor vehicle. This control device comprises: a voltage generator operable selectively to provide a first predetermined reference voltage corresponding to a desired speed of displacement of the movable core coupled to the solenoid, and a second reference voltage of lower value than the first; a sensor operable to provide a signal indicative of the current flowing in the solenoid; an amplifier having a variable gain with its input connected to this sensor; and a summing device with first and second inputs connected to the generator and the output of the amplifier respectively, and having an output connected to the solenoid. A control and calibration circuit controls the generator when the control device is activated, initially to generate a low reference voltage and then to provide the amplifier with a signal such that its gain increases until the voltage applied to the solenoid reaches a predetermined maximum value, and the signal at the output of the amplifier corresponds to the voltage drop across the resistance of the solenoid; it finally maintains the gain of the amplifier at this value and controls the generator to generate the first reference voltage.

6 Claims, 4 Drawing Sheets

CONTROL CIRCUIT FOR AN ELECTROMAGNET ASSOCIATED WITH AN ELECTRIC STARTER MOTOR FOR AN INTERNAL COMBUSTION ENGINE

BACKGROUND OF THE INVENTION

The present invention relates to a circuit device for controlling the pilot voltage applied to the solenoid of an electromagnet associated with an electric starter motor for an internal combustion engine of a motor vehicle.

The electromagnet, which is typically associated with an electric starter motor for a motor vehicle, is intended to cause a drive pinion to mesh with the teeth of a rotatable member (ring) of the internal combustion engine just before the starter motor is energised to cause rotation of the pinion. To this end the movable core of the electromagnet is coupled to a lever which controls displacement of the pinion.

Upon each starting operation a piloting voltage is applied to the solenoid of the electromagnet and the movable core translates by the effect of the field generated by the solenoid and, via the lever, urges the pinion towards the starter ring of the internal combustion engine.

In order to reduce the violence of the impact of the pinion against the starter ring of the internal combustion engine it is desirable to be able to control the speed of displacement of the said movable core.

SUMMARY OF THE INVENTION

The object of the present invention is to provide a circuit device which makes it possible to control the pilot voltage applied to the solenoid of such an electromagnet in such a way as to permit control of the speed of displacement of the associated movable core to be achieved.

BRIEF DESCRIPTION OF THE INVENTION

Further characteristics and advantages of the invention will become apparent from the following detailed description given purely by way of non-limitative example, with reference to the attached drawings, in which.

DETAILED SUMMARY OF THE INVENTION

Figure 1:
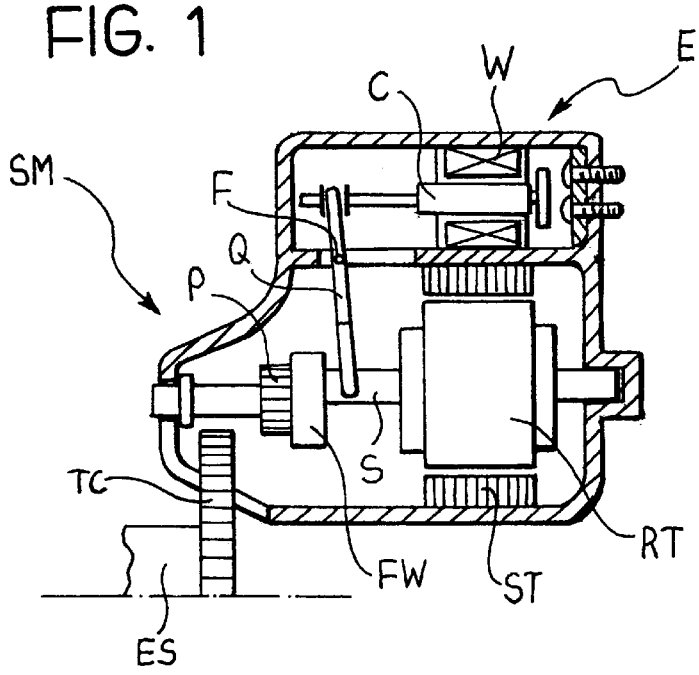
FIG. 1 is a schematic representation, in section, of an electric starter motor and the associated electromagnet.

In FIG. 1 the reference SM indicates an electric starter motor for an internal combustion engine for motor vehicle. The motor SM has an associated electromagnet generally indicated E.

In a manner know per se the motor SM comprises a stator ST with a shaft S on which are slidably mounted a pinion P and an overrun or freewheel coupling FW.

The electromagnet E comprises a stationary solenoid W having an associated movable core C connected to a lever Q which, being pivoted at F, allows displacement of the pinion P towards a toothed ring TC carried by the shaft ES of the internal combustion engine to be controlled.

When a pilot voltage is applied to the solenoid W the field created within this solenoid causes a displacement of the core C (towards the left as seen in FIG. 1) and the rotation of the lever Q about the fulcrum F causes displacement of the pinion P towards the toothed ring TC.

Figure 2:
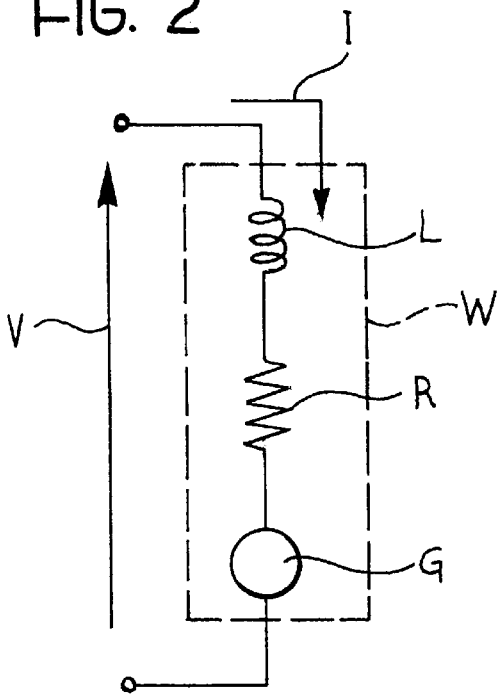
FIG. 2 is a representation of the equivalent circuit of the solenoid of an electromagnet associated with an electric starter motor.

In FIG. 2 the operating equivalent circuit of the solenoid W of the electromagnet E is shown. This equivalent circuit comprises, in series, an inductance L, a resistance R and a voltage generator G. This generator represents the counter-electromotive force fcem which is generated in the solenoid W upon displacement of the core in the field produced by this solenoid.

In FIG. 2 V indicates the voltage applied to the solenoid W and I indicates the corresponding current flowing in this solenoid.

During displacement of the core C the following relationship is generally true:

$$V = L \cdot \frac{dI}{dt} + R \cdot I + fcem \tag{1}$$

The counterelectromotive force fcem is proportional to the speed of displacement v of the core C.

In view of this, the speed of displacement v of the movable core C would in theory be controllable if it were possible to control the counterelectromotive force fcem developed in the solenoid W.

Control of the counterelectromotive force fcem is, however, problematic in that it is not directly measurable. In effect, the only electrical quantities which are easily measurable are the voltage V applied to the solenoid W and the current I flowing in it.

Moreover, in the relation (1) presented above the resistance R which, to a close approximation, can be considered to be constant in each phase of energisation of the solenoid W, has a value which is strongly dependent on the operating temperature, which however can vary within a rather wide range, for example −20° C. to +100° C.

The invention is based on the fact that if a variable voltage V is applied to the solenoid W in such a way that the current I in the solenoid varies relatively slowly, the voltage drop LdI/dt across the inductance L of the solenoid is negligible to a close approximation. In such condition the above relation (1) becomes:

$$V \cong R \cdot I + fcem \tag{2}$$

The relation (2) indicates that the counterelectromotive force fcem (and therefore the speed of the movable core C) can be controlled by controlling the voltage V applied to the solenoid if the resistance R of the solenoid can be determined in some way, or rather if the voltage drop RI across this resistance can be determined.

The invention is further based on the fact that if the variable voltage V applied to the solenoid W has a very low value, insufficient to cause displacement of the core C, the counterelectromotive force fcem induced in the solenoid is nil. In this condition, as appears from relation (2) above, it is possible to determine the voltage drop RI across only the resistance of the solenoid, that is the resistance R.

As will become more clearly apparent hereinafter, according to the invention the solenoid W has a positive feedback circuit associated with it, by means of which upon each activation of the solenoid an initial calibration phase is actuated to determine the resistance R of the solenoid that is the voltage drop RI across this resistance, followed by a solenoid energisation phase in which the feedback circuit acts such that the counterelectromotive force fcem induced on the solenoid, and therefore the speed of the movable core of the electromagnet, assumes a predetermined value.

In the solenoid calibration phase a lower voltage than that sufficient to cause displacement of the core is applied, increasing in such a way that the current I in the solenoid varies slowly such that the voltage drop LdI/dt across the inductance L of the solenoid is essentially negligible.

The above is achieved, for example with the control circuit which will now be described with reference to FIG. 3.

Figure 3:
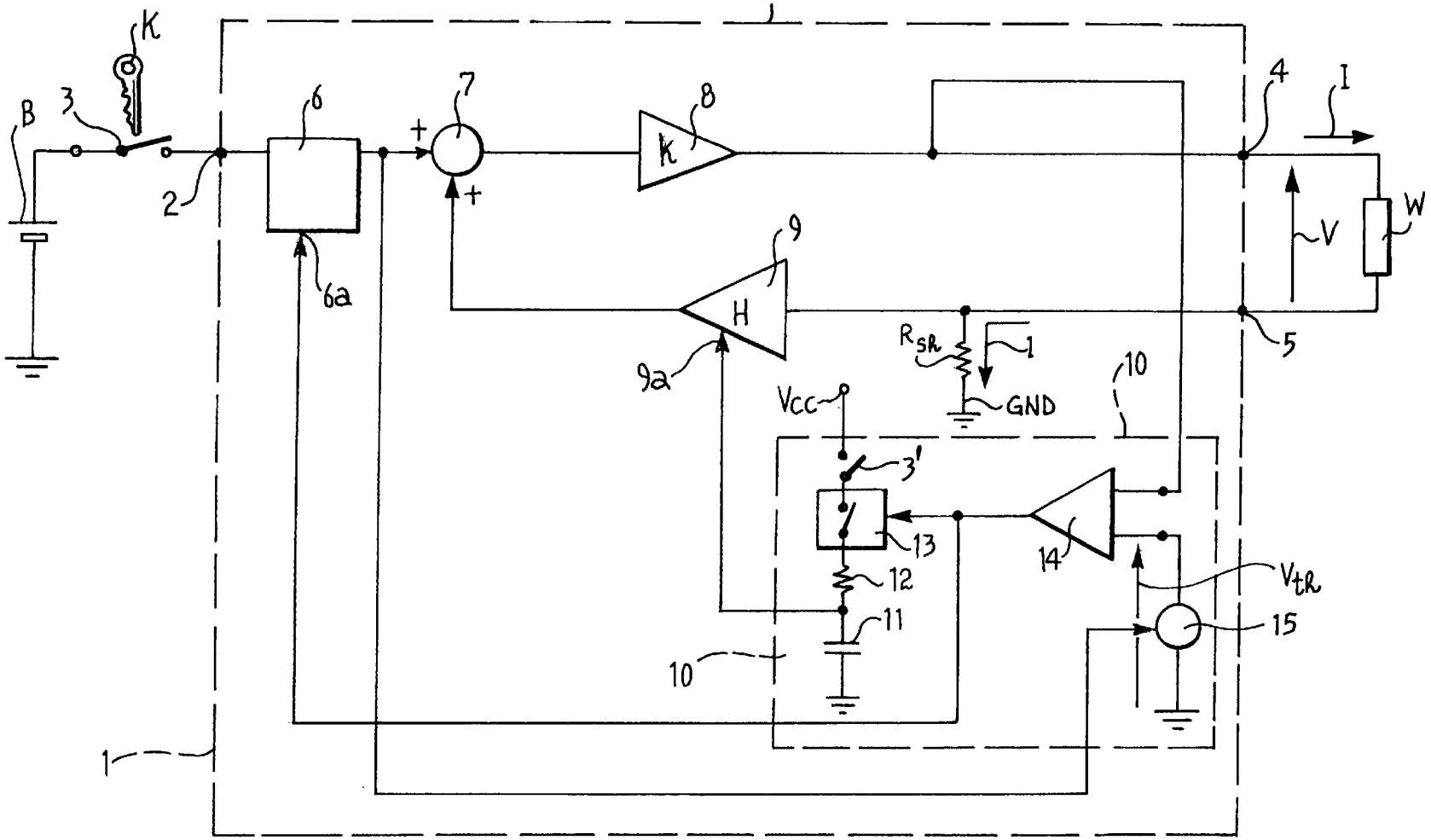
FIG. 3 is a partial block diagram of a circuit according to the invention.

In FIG. 3 a control circuit according to the invention is generally indicated 1. This device has an input terminal 2 connectable to the battery B of the motor vehicle via a switch 3 which can be incorporated for example in a typical ignition and starter switch operable by means of a key K. The control circuit 1 has two output terminals 4 and 5 between which the solenoid W is connected.

The control circuit 1 includes a voltage generator 6 the input of which is connected to the terminal 2 and which acts to provide at its output, selectively, a first predetermined reference voltage $V_R$ corresponding to a desired speed of displacement of the movable core C, and a second reference voltage $V_r$ of lower value than the voltage $V_R$.

The voltage generator 6 generates one or the other reference voltage in dependence on the level or state of a control signal applied to its input indicated 6*a*.

The output of the voltage generator 6 is connected to a first input of a summing device 7 the output of which is connected to an amplifier 8 having a gain k. This amplifier can for example be a voltage-follower amplifier or another device which will be discussed hereinafter.

The output of the amplifier 8 is connected to the terminal 4 and therefore to one end of the solenoid W.

A shunt resister $R_{sh}$ is connected between ground GND and the other end of the solenoid W (terminal 5 ). The terminal 5 is connected to the input of a variable gain amplifier 9. The amplifier 9 is in particular a voltage controlled amplifier (VCA) and has a gain H the value of which varies in dependence on a control voltage applied to its input 9*a*.

The output of the amplifier 9 is connected to the second input of the summing device 7.

The control input 9*a* of the amplifier 9 is connected to the output of a control and calibration circuit generally indicated 10 in FIG. 3.

In the exemplary embodiment illustrated in this Figure the control and calibration circuit 10 comprises a capacitor 11 connected between the input 9*a* of the amplifier 9 and ground.

A resistor 12 is connected between the capacitor 11 and a DC voltage supply source $V_{cc}$, in series with a switch 3' coupled to the switch 3 and an electronic switch 13 controlled by the output of a threshold comparator 14. This latter has a first input connected to the terminal 4 and a second input connected to a threshold voltage generator 15. The generator 15 generates the threshold voltage $V_{th}$.

The threshold comparator 14 compares the voltage V across the solenoid W with the threshold voltage $V_{th}$ to cause the switch 13 to open when the voltage V reaches the value $V_{th}$.

The generator 6, the summing device 7 and the amplifiers 8 and 9 are connected to the solenoid W in such a way as to form a positive feedback circuit. If the generator 6 provides an output voltage $V_R$ the voltage V assumes the value $$V = V_R \cdot \frac{k}{1 - k \cdot H \cdot \frac{R_{sh}}{R}} \tag{3}$$

The following relation is also true:

$$V = k(H \cdot Rsh \cdot I + V_R) \tag{4}$$

The above presented equation (4) is analytically homogeneous with the relation (2). The comparison of the relations (2) and (4) indicates that it is possible to control the counterelectromotive force fcem in such a way that it assumes the value $kV_R$ if the gain H of the amplifier 9 can be calibrated in dependence on the value of the resistance R of the solenoid W.

The circuit 1 of FIG. 3 operates as follows.

When, in order to cause excitation of the electromagnet E, the switch 3 is closed, the solenoid W has no current flowing through it. The electronic switch 13 is closed.

Closure of the switch 3 causes consequent closure of the switch 3'. The voltage across the capacitor 11 initially has a nil value, and therefore the initial value of the gain H of the amplifier 9 is nil.

Closure of the switch 3 likewise causes activation of the generator device 6 which provides at its output the low reference voltage $V_r$. This voltage arrives at the input of the amplifier 8 the output of which therefore has a voltage $kV_r$. This latter voltage is applied to the solenoid W in which current begins to flow. Simultaneously the voltage across the capacitor 11 begins to increase and, correspondingly, the gain H of the amplifier 9 increases. Consequently the voltage V across the solenoid W increases according to the relation $$V = V_r \cdot \frac{k}{1 - k \cdot H \cdot \frac{R_{sh}}{R}} \tag{5}$$

which is identical in form to relation (3) above.

From the relation (5) it can be seen that the voltage V on the solenoid W gradually increases which increases the gain H of the amplifier 9.

From this relation it can also be deduced that if $kHR_{sh}/R$ tends to 1 the voltage V tends to an infinitely large value.

As previously mentioned, in the initial calibration phase the voltage V across the solenoid W must however remain less than the minimum value sufficient to cause displacement of the movable core of the electromagnet. This means that the term $kHR_{sh}/R$ must be correspondingly limited.

If, for example, this term is limited to a value equal to 0.9 the voltage V on the basis of relation (5) can become greater than a value $V_{MAX}$=10 $kV_r$.

The voltage $V_r$ must then be predetermined in such a way that $V_{MAX}$ is always less than the minimum value sufficient to cause displacement of the movable core of the electromagnet.

Limitation of the increase in the gain H of the amplifier 9 in such a way that $kHR_{sh}/R$ is equal to at most (for example) 0.9 is achieved by the threshold comparator 14. This comparator in effect compares the voltage V across the solenoid W with a threshold value $V_{th}$ which in this case is predetermined in such a way that it is equal $10kV_r$.

Figure 4:
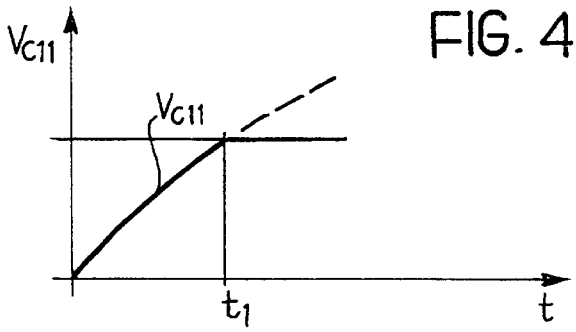
FIG. 4 is a graph which shows an exemplary variation of a control voltage generated in the circuit of FIG. 3.

When the voltage V reaches the value $V_{th}$ the threshold comparator 14 causes the switch 13 to open and thus interrupts the increase in the voltage across the capacitor 11 and, therefore, interrupts the increase in the gain H of the amplifier 9. This occurs at an instant indicated $T_1$, in FIG. 4, in which the variation of the voltage $V_{c11}$ across the capacitor 11 is qualitatively shown as a function of time t plotted on the abscissa and measured starting from the instant of closure of the switch 3.

At this point the calibration phase of the gain H of the amplifier 9 is terminated.

As well as stopping the gain H of the amplifier 9 switching of the threshold comparator 14 causes emission by the voltage generator 6 of the reference voltage VR corresponding to the desired speed of displacement of the electromagnet core. At this point the voltage which is applied to the solenoid W assumes the value defined by the previously presented relation (4) in which H is the gain value of the amplifier 9 reached at the end of this calibration phase.

In the embodiment described above with reference to FIG. 3, in the initial calibration phase the gain H of the amplifier 9 increases substantially following the variation of the increase in the voltage across the capacitor 11. Upon increase in the gain H the voltage V across the solenoid W correspondingly increases and therefore the current I which flows in the solenoid also increases correspondingly.

As previously mentioned, it is suitable that in this initial calibration phase the current I in the solenoid has a modest rate of increase so that the voltage drop across the inductance L of this solenoid can effectively be negligible.

To this end it is therefore suitable that the gain H of the amplifier 9 in the calibration phase or, at least at the end of this phase, increases slowly.

With the arrangement according to FIG. 3, in which the voltage which controls the gain H varies according to the charging of the capacitor 11 and with a time constant corresponding to the capacity of this capacitor and the resistance of the resistor 12, the condition of slow increase of the gain H at least in the final part of the calibration phase can take a long time.

Figure 5:
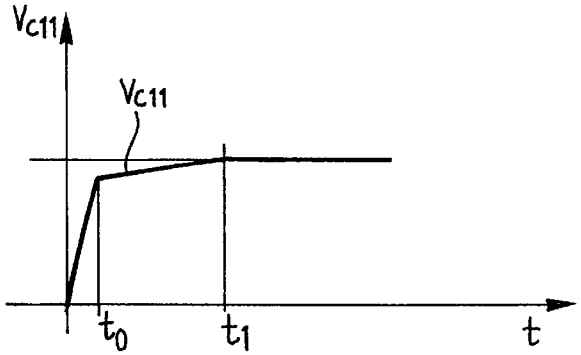
FIG. 5 is a graph which shows another exemplary variation of a control voltage generated in a circuit according to the invention.

For the purpose of shortening these times the arrangement which will now be described with reference to FIGS. 5 and 6 can conveniently be adopted. As shown by the graph of FIG. 5 this arrangement provides that the voltage $V_{c11}$ across the capacitor 11 is made to rise initially in a rapid manner up to an instant $t_0$ to and then in a relatively slow manner up to the instant $t_1$, at which the calibration phase ends.

This can be achieved with a control and calibration circuit 10 of the type which will now be described with reference to FIG. 6.

Figure 6:
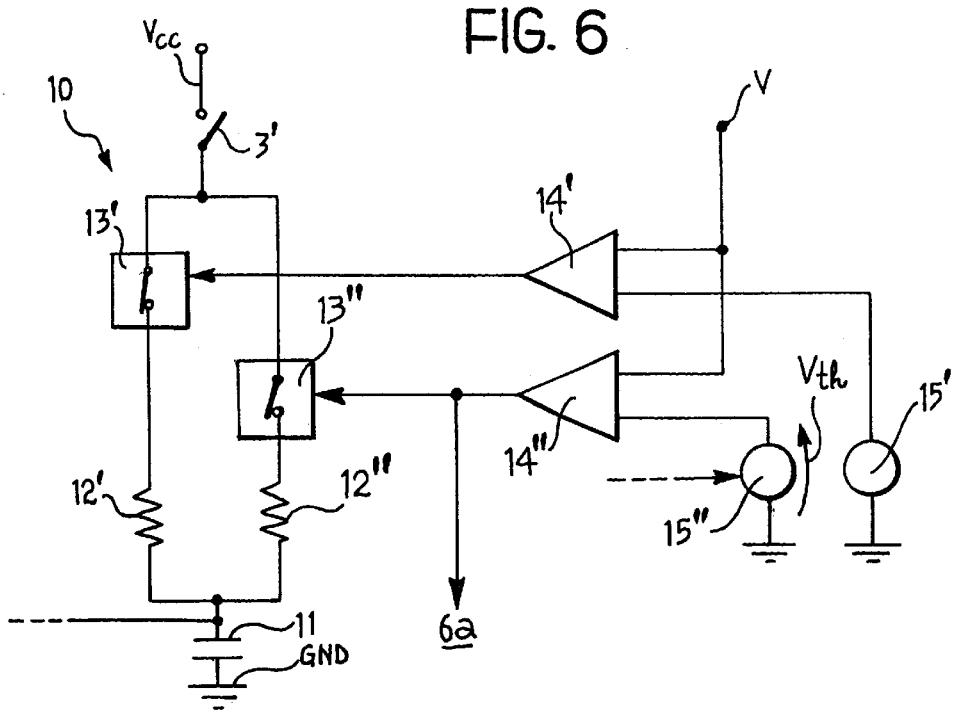
FIG. 6 is a circuit diagram of an alternative embodiment of a calibration and control circuit for a device according to the invention.

In the circuit 10 of FIG. 6 two circuit branches in parallel with one another are connected between the capacitor 11 and the voltage source $V_{cc}$, and respectively comprise electronic switches 13' and 13" in series with which are disposed respective resistors 12' and 12". The switches 13' and 13" are controlled by respective threshold comparators 14' and 14" which compare the voltage V across the solenoid with respective reference voltages provided by threshold voltage generator circuits 15' and 15'.

The resistor 12' has a significantly lower resistance than that of the resistor 12", for example equal to one tenth of this latter. The threshold voltage generated by the circuit 15' associated with the threshold comparator 14' is lower than the threshold voltage $V_{th}$ generated by the circuit 15", this latter however being determined in the previously-described manner with reference to the circuit of FIG. 3.

In operation, upon the commencement of the initial calibration phase of the gain H of the amplifier 9, the switches 13' and 13" are both closed. The voltage $V_{c11}$ across the capacitor 11 thus rises with a time constant which depends on the capacity of this capacitor and on the equivalent resistance of the parallel resistors 12' and 12". This equivalent resistance is small. Therefore the voltage across the capacitor 11 rises initially in a rapid manner as is indicated by the initial section (before instant $t_0$) in the graph of FIG. 5. When the voltage V across the solenoid W reaches the threshold value generated by the circuit 15' the threshold comparator 14' causes the switch 13' to open. This situation corresponds to the instant $t_0$ of FIG. 5. Starting from this instant the voltage across the capacitor 11 further increases, but with a time constant which now depends on the capacity of this capacitor and the resistance of the resistor 12" which is relatively large. The increase in the voltage across the capacitor 11 therefore assumes a slower progress as is shown in the graph of FIG. 5, between instance $t_0$ and $T_1$.

When the voltage V across the solenoid W reaches the threshold $V_{th}$ the threshold comparator 14" causes the switch 13" to open (instant $t_1$) and stop applying voltage to the capacitor 11.

The solenoid W can in general be piloted with an analogue voltage or with a square wave voltage having a variable duty cycle (pulse width modulated voltage or PWM). In this latter case the considerations set out above and the relations presented have essentially unchanged values if the average value of the PWM voltage applied to the solenoid W is taken for voltage V. Moreover, as will appear evident to those skilled in the art, in the case of piloting of the solenoid with a PWM signal, it is necessary to interpose a PWM modulator circuit between the amplifier 8 and the solenoid W and between the shunt resistor and the input of the amplifier 9 it is necessary to interpose a filter. Likewise, a filter must be interposed between the terminal 4 of the control circuit 1 and the input of the threshold comparator circuit 14 (or threshold comparators 14' and 14").

Figure 7:
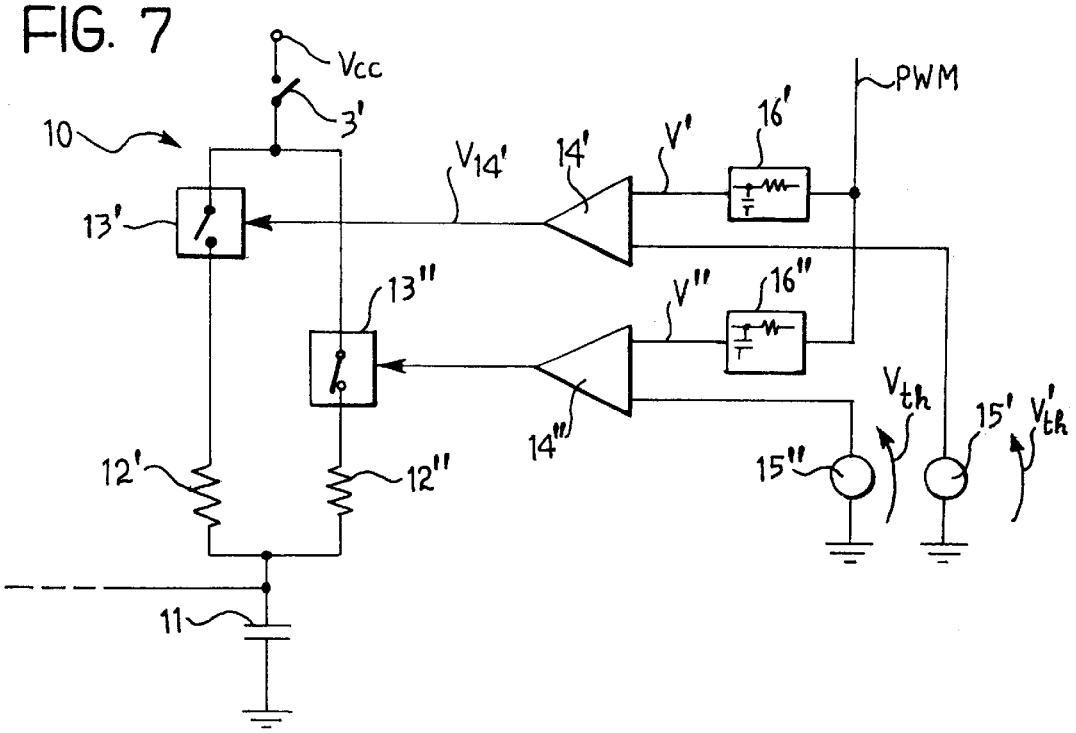
FIG. 7 is a circuit diagram of a further variant embodiment of a calibration and control circuit.
Figure 8:
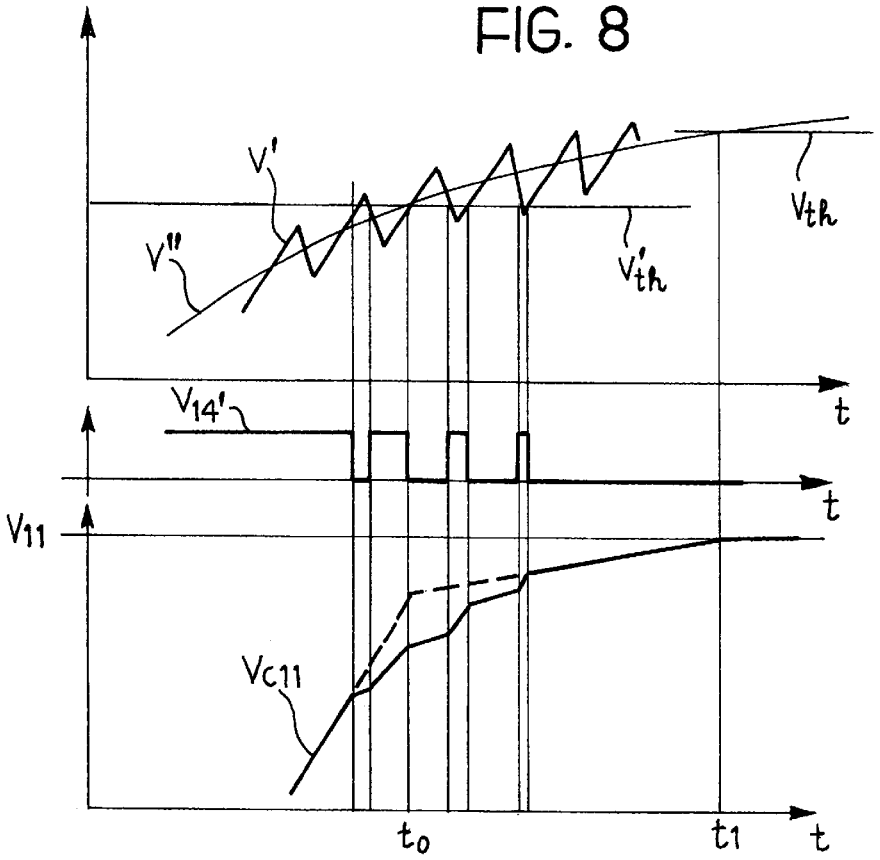
FIG. 8 is a series of graphs which show exemplary variations in dependence on time plotted along the abscissa of several signals generated in the circuit of FIG. 7.

In FIG. 7 there is shown an alternative embodiment of the circuit according to FIG. 6 which can be utilised when the solenoid W is piloted by a PWM signal of average value V. In FIG. 7 the devices and components already described with reference to FIG. 6 have again been given the same reference numerals. In the embodiment of FIG. 7 the PWM voltage, which in the initial calibration phase is applied to the solenoid W, arrives at the inputs of the threshold comparators 14' and 14" passing through to different filters 16' and 16". The filter 16' is formed in such a way that the signal V' at its output again has an appreciable undulation or ripple synchronised with the PWM signal as is qualitatively illustrated in the graph of FIG. 8. The filter 16' is on the other hand formed in such a way that the signal V" emerging from it corresponds effectively to the average value V of the PWM signal and is therefore substantially free of ripple, as is shown in the graph of FIG. 8.

The threshold comparator 14' compares the signal V' with a threshold voltage $V'_{th}$ provided by the circuit 15'. Correspondingly, the signal $V'_{14}$ at the output of the comparator 14' has a variation qualitatively indicated in the intermediate graph of FIG. 8. It remains at a level (for example "high") for as long as the signal V' is lower than the threshold $V'_{th}$, and then remains definitively at the other level (for example "low" level) when the signal V' definitively exceeds the threshold $V'_{th}$. The presence of the ripple in the signal V' however causes a series of further intermediate commutations of the level of the signal $V'_{14}$ (FIG. 8) as a consequence of which the voltage $V_{c11}$ across the capacitor 11 increases as shown by the segmented line, alternately with the initial and final time constants.

As a consequence of the switching of the intermediate level of the signal $V_{14}$, the voltage across the capacitor 11 in the intermediate part of the initial calibration phase increases on average in a gradual manner and its variation with time does not have the characteristic "knee" of FIG. 5.

The more gradual increase in the voltage across the capacitor 11 and therefore of the gain H of the amplifier 9 in the calibration phase makes it easier to limit the rate of variation of the current I in the solenoid W such that the voltage drop across the inductance L of the solenoid W can effectively be negligible.

Naturally, the principle of the invention remaining the same, the embodiments and details of construction can be widely varied with respect to what has been described and illustrated purely by way of non-limitative example, without by this departing from the ambit of the invention as defined in the attached claims.

What is claimed is:

1. A circuit device for controlling the piloting voltage applied to the solenoid of an electromagnet associated with an electric starter motor for an internal combustion engine of a motor vehicle; the said solenoid having an inductance and a resistance and being coupled to a core movable with respect thereto; the control device comprising voltage generator means operable selectively to provide a first predetermined reference voltage corresponding to a desired speed of displacement of the said core, and a second reference voltage of lower value than the first;

sensor means operable to provide a signal indicative of the current flowing in the solenoid;

an amplifier having a variable gain and its input connected to the said sensor means;

a summing device with first and second inputs connected to the said generator means and the output of the amplifier respectively; the output of the summing device being coupled to the solenoid; and control and calibration circuit means acting, each time the control device is activated to provide the said generator means with a signal to initially generate the said lower second reference voltage, then provide to the amplifier a signal to increase the gain of the amplifier up to a value where the voltage applied to the solenoid reaches a predetermined maximum value still less than that required to cause displacement of the core, and the output signal from the amplifier substantially corresponds to the voltage drop across only the resistance of the solenoid; and then maintain the gain of the amplifier at the said value, and provide to the generator means a signal to generate the said first reference voltage.

2. A device according to claim 1, in which the said amplifier has an input for a gain control voltage, and the control and calibration circuit means comprise a generator circuit acting, when it receives an enablement signal, to provide an increasing voltage to the said input of the amplifier, and threshold comparator means acting to provide the said enablement signal to this generator circuit when the voltage across the solenoid is less than a predetermined value.

3. A device according to claim 2, in which the said generator circuit comprises a capacitor connectable to a DC voltage source via at least one resistor, and a switch controlled by the said threshold comparator means.

4. A device according to claim 2, in which the said generator circuit comprises a capacitor connectable to a DC voltage source by means of first and second circuit branches connected together in parallel and respectively comprising resistors in series and respective switches controlled by the said comparator means in dependence on the voltage applied to the solenoid in such a way that the voltage across the said capacitor is able initially to increase in a rapid manner and then increase more slowly.

5. A device according to claim 4, in which the said solenoid has applied thereto a square wave control voltage of variable duty cycle and in which the said calibration and control circuit means comprise a first filter connected to the solenoid to provide an output signal corresponding to the average value of the said control signal over which is superimposed a ripple component substantially synchronous with the said control signal, and a second filter operable to provide an output signal corresponding to the average value of the said control signal;

said first and second filter having their outputs connected to the input of first and second threshold comparators with which are associated respective threshold voltages; the threshold voltage associated with the first comparator circuit being lower than the threshold voltage associated with the second comparator circuit;

the output from the first comparator controlling the switch of the circuit branch comprising the resistor of lower resistance; the second comparator controlling the switch of the other circuit branch.

6. A device according to claim 1, wherein the said sensor means comprise a shunt resistor connected to the said solenoid.

* * * * *